US009470429B2

(12) United States Patent
Hopper et al.

(10) Patent No.: US 9,470,429 B2
(45) Date of Patent: Oct. 18, 2016

(54) VENTILATION ARRANGEMENT

(75) Inventors: Nicholas John Hopper, High Wycombe (GB); Anthony Francis Cull, High Wycombe (GB)

(73) Assignee: VKR Holding A/S, Horsholm (DK)

( * ) Notice: Subject to any disclaimer, the term of this patent is extended or adjusted under 35 U.S.C. 154(b) by 775 days.

(21) Appl. No.: 13/810,492

(22) PCT Filed: Jul. 18, 2011

(86) PCT No.: PCT/GB2011/001070
§ 371 (c)(1),
(2), (4) Date: Sep. 3, 2013

(87) PCT Pub. No.: WO2012/010823
PCT Pub. Date: Jan. 26, 2012

(65) Prior Publication Data

US 2013/0344793 A1 Dec. 26, 2013

(30) Foreign Application Priority Data

Jul. 19, 2010 (GB) ..... 1012116.8

(51) Int. Cl.
*F24F 7/02* (2006.01)
*F24F 13/08* (2006.01)
*E04D 13/17* (2006.01)

(52) U.S. Cl.
CPC ..... *F24F 7/02* (2013.01); *E04D 13/17* (2013.01); *F24F 13/082* (2013.01); *F24F 2221/52* (2013.01)

(58) Field of Classification Search
CPC ..... F24F 7/02; F24F 13/082; F24F 13/14; F24F 2221/52; F24F 2221/16; E04D 13/17
USPC ..... 454/242
See application file for complete search history.

(56) References Cited

U.S. PATENT DOCUMENTS

| | | | | |
|---|---|---|---|---|
| 1,897,440 A * | 2/1933 | Richardson | F23L 17/10 454/31 |
| 3,830,147 A * | 8/1974 | Weber | F24F 13/18 251/298 |
| 4,036,120 A * | 7/1977 | Burtenshaw | F24F 7/025 454/34 |

FOREIGN PATENT DOCUMENTS

| | | |
|---|---|---|
| DE | 1268344 | 5/1968 |
| FR | 69380 | 11/1958 |
| FR | 2916518 | 11/2008 |
| GB | 2355067 | 4/2001 |

OTHER PUBLICATIONS

International Patent Application No. PCT/GB2011/001070, International Search Report and Written Opinion mailed Nov. 3, 2011 (7 pages).

* cited by examiner

*Primary Examiner* — Steven B McAllister
*Assistant Examiner* — Ko-Wei Lin
(74) *Attorney, Agent, or Firm* — Kilpatrick Townsend & Stockton LLP

(57) ABSTRACT

A housing for a ventilation arrangement, with a profiled rod providing a radial extension in each corner, with a pivotted guide vane extending between the rod and the remainder of the housing. In normal wind conditions this radial extension guides air into or out of the housing. In very high wind conditions the guide vane can however pivot and/or flex to release any excessive pressure caused by the high wind.

10 Claims, 3 Drawing Sheets

VENTILATION ARRANGEMENT

CROSS REFERENCE TO RELATED APPLICATIONS

This application is the U.S. national phase of International Application No. PCT/GB2011/001070 filed on Jul. 18, 2011, and published in English on Jan. 26, 2012 as International Publication No. WO 2012/010823 A1, which application claims priority to Great Britain Patent Application No. 1012116.8 filed on Jul. 19, 2010, the contents of both of which are incorporated herein by reference.

The present invention relates to a ventilation arrangement for ventilating a building interior.

The provision of adequate ventilation is an important consideration in building design. The combination of heat gains generated within buildings by occupants and electrical equipment and solar heat gain can cause a significant build up of heat and, therefore overheating.

Air conditioning or other mechanical ventilation systems can be used to provide ventilation to buildings to address these difficulties. However, such systems consume electricity and can, therefore, be relatively expensive to operate.

One prior arrangement is to provide a duct extending from just above roof level into a building, with the upper end of the duct connecting to outwardly facing openings extending around the duct. During use air can enter the windward side of the duct through respective openings, with stale air exiting from the building through respective openings on the leeward side of the duct.

In such a configuration, the duct is divided by radial dividers, which could for instance divide the duct into four quadrants, with the quadrant nearest the windward side receiving the most air to ventilate the building, whilst the majority of air extracted from the building exits through the opposite quadrant on the leeward side of the arrangement.

Such arrangements have operated successfully in providing ventilation with little or no power input. However, problems can be encountered in extreme weather with such arrangements, for example with very heavy rain and particularly snow, leading to ingress of precipitation into the apparatus.

According to the present invention there is provided a ventilation arrangement for ventilating a building interior, the ventilation arrangement comprising: an air duct which extends in use from roof level into an interior of the building to be ventilated to convey air between the exterior and interior of the building; a housing locatable on the roof of a building, with ventilation openings provided around the perimeter of the housing to direct moving air caused by wind movement into or out of an upper part of the air duct; and a plurality of guide vanes extending outwardly from the housing to guide air into the housing, with the guide vanes spaced around the housing.

The guide vanes may extend substantially radially from the housing.

The guide vanes may comprise elongate members running substantially vertically. The elongate members may be in the form of strips of material.

The guide vanes may be flexible so as to flex in high wind conditions.

The guide vanes may be made of a flexible material, and may be made of rubber or a plastics material.

Each guide vane may be mounted to a one only of a first inner part of the housing or a respective second more outwardly part of the housing, and extend between the first and second parts.

Each guide vane may be mounted to the first inner part of the housing.

The second part of the housing may comprise an elongate vertically extending part which defines an elongate gap between the second part and the remainder of the housing, which gap in normal wind conditions is at least substantially closed by a respective guide vane.

The arrangement may be configured such that in high wind conditions a respective guide vane can be moved by the wind to open the elongate gap.

In one embodiment the guide vane is flexible such that in high wind conditions the guide vane flexes.

In a further embodiment the guide vane may be pivotally mounted to a one of the first or second parts, and in high wind conditions the guide vane is pivotally moved by the wind to open the elongate gap.

In one arrangement the housing is substantially square in plan view, and a guide vane is provided at each corner of the housing. The guide vanes may extend at a horizontal inclination of substantially 135° to the sides of the housing.

An embodiment of the present invention will now be described by way of example only and with reference to the accompanying drawings, in which.

Figure 1:
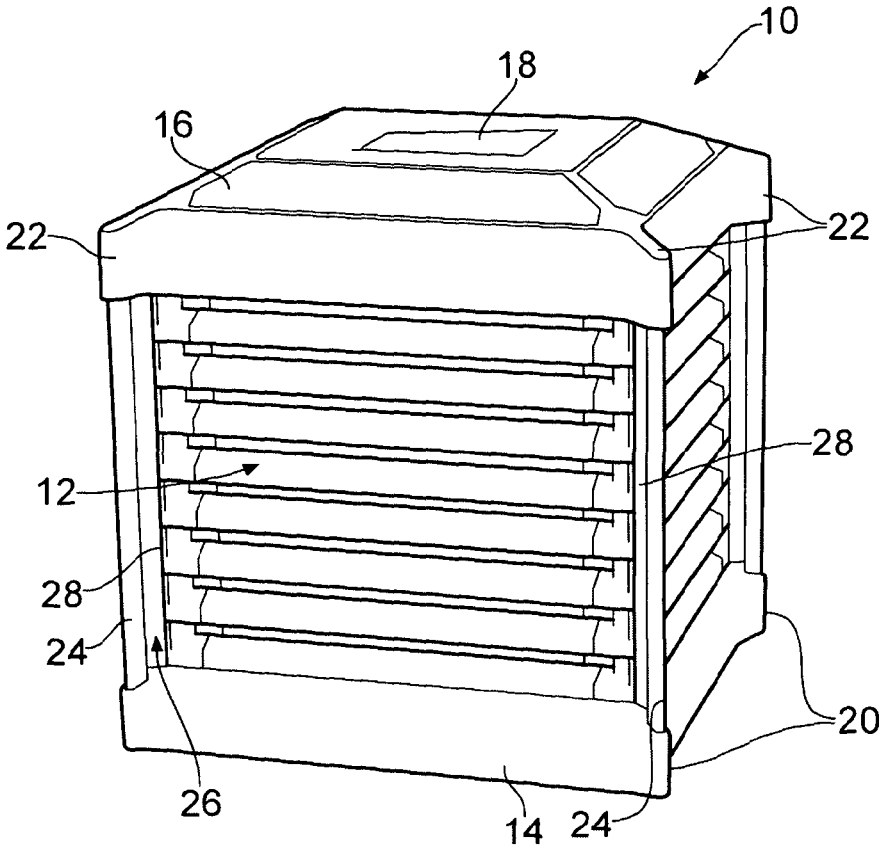
FIG. 1 is a diagrammatic perspective view of part of a ventilation arrangement according to the invention.

The drawings show part of a ventilation arrangement mountable on the roof of a building to provide ventilation into and out of the building. The arrangement includes a duct (not visible) extending through the arrangement. The arrangement has a housing 10 locatable on the roof of a building, which housing is of generally square configuration in plan view. Openings are provided on each side of the housing 10 defined by respective louvre arrangements 12.

The housing 10 comprises a lower base section 14 with the louvre arrangements 12 extending upwardly therefrom, and an upper cap section 16. The cap section 16 includes a solar panel 18 for use in powering the arrangement and/or other units.

Radial extensions 20, 22 extend respectively from the base section 14 and cap section 16 at each corner. A profiled rod 24 extends between each respective pair of extensions 20, 22 towards the outer ends thereof defining a gap 26 between each rod 24 and the remainder of the housing 10.

A guide vane 28 extends from a main part of the housing 10 opposite each rod 24 to substantially contact the respective rod 24 in normal wind conditions to close the gap 26. The guide vane 28 is in the form of a length of rubber of constant cross section, with the cross section including a bulbous inner end 30 which locates in a recess 32 in the housing, with a gently tapering section 34, extending to the rod 24.

The arrangement works by air entering a side or sides of the housing 10 on a windward side, and passing down the duct into the building, with air exiting on a leeward side or sides of the housing 10 from the building through the duct.

Figure 2:
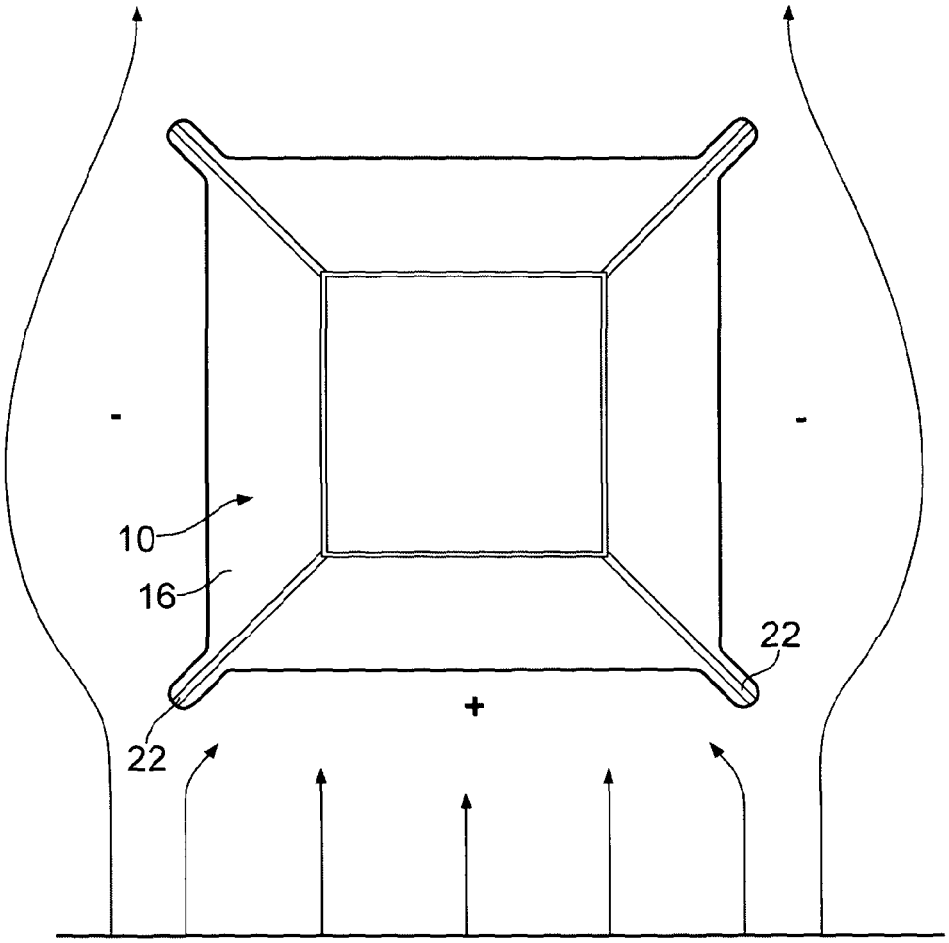
FIG. 2 is a diagrammatic plan view of a part of the ventilation arrangement shown in FIG. 1.

The provision of the rods 24 and guide vanes 28 provides an increased area for receiving air to enter the housing on a windward side, by directing air on the outer extremes of the respective side towards the respective louvre arrangement 12. This is illustrated best in FIG. 2, which also illustrates that the rods 14 and guide vanes 18 cause an increase in relative positive pressure on the windward side of the housing 10, with a corresponding relative negative pressure on the leeward side or sides of the housing 10. This relative pressure differential provides an increased supply and extraction of air flow through the arrangement.

Figure 4:
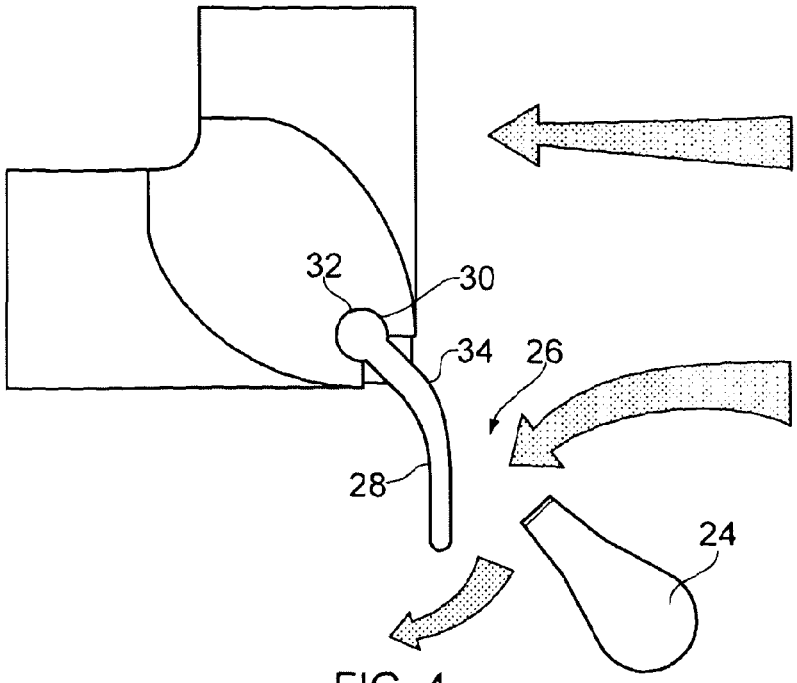
FIG. 4 is a similar view to FIG. 3 but in high wind conditions.
Figure 3:
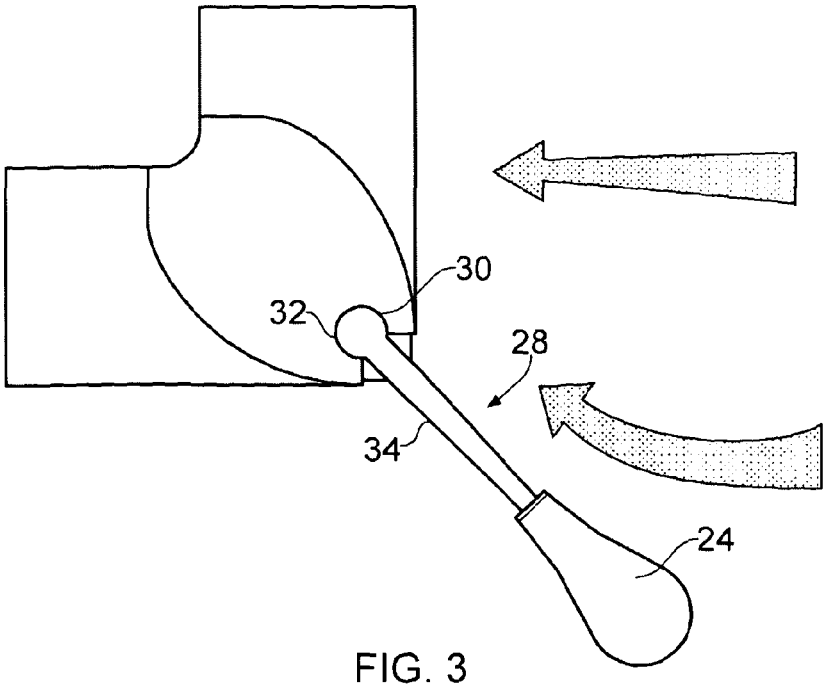
FIG. 3 is a diagrammatic cross sectional view of a portion of the ventilation arrangement shown in FIG. 1 in normal wind conditions.

If high winds are encountered, which otherwise may cause damage to the rods 24, guide vanes 28 and/or the louvre arrangements 12, the guide vanes 28 can flex as shown in FIG. 4 to relieve the pressure on the windward side of the housing 10. Once the winds have decreased in force and hence the pressure decreased, the respective guide vanes 28 will flex back to the condition shown in FIG. 3.

There is thus described a ventilation arrangement which by virtue of the rods and guide, vanes provides for increased efficiency in capturing more air and obtaining a greater air pressure on a windward side than would be obtained by a simple square plan housing. The apparatus is however of relatively conventional construction and can thus be made for long term essentially maintenance free operation, with the flexing arrangement alleviating the damage which could be caused by high wind conditions.

Various modifications may be made without departing from the scope of the invention. For instance rather than using a flexible guide vane, the guide vane could be pivotally mounted to the housing, with a mounting such that pivotal movement only occurs when a force above a predetermined level is applied, such as may be encountered in high wind conditions. The guide vanes and/or rods may take a different form. The guide vanes could be mounted to the rods, and free at their inner ends. The housing may have a different shape to square, and could for instance have a larger number of sides.

Whilst endeavouring in the foregoing specification to draw attention to those features of the invention believed to be of particular importance it should be understood that the Applicant claims protection in respect of any patentable feature be combination of features hereinbefore referred to and/or shown in the drawings whether or not particular emphasis has been placed thereon.

The invention claimed is:

1. A ventilation arrangement for ventilating a building interior, the ventilation arrangement comprising:

an air duct which extends in use from roof level into the interior of the building to be ventilated to convey air between an exterior and the interior of the building;

a housing locatable on the roof of the building, with ventilation openings provided around a perimeter of the housing to direct moving air caused by wind movement into or out of an upper part of the air duct; and a plurality of guide vanes spaced around the housing and extending outwardly from the housing to guide air into the housing, each of the plurality of guide vanes being mounted to only one of a first inner part of the housing or a respective second part of the housing and extending between the first inner part and the second part, the second part comprising an elongate vertically extending part which defines an elongate gap between the second part and a remainder of the housing, wherein the elongate gap in normal wind conditions is at least substantially closed by a respective guide vane, the guide vanes being flexible so as to flex in high wind conditions to relieve pressure on a windward side of the housing, the windward side of the housing comprising an outside surface of the housing.

2. A ventilation arrangement according to claim 1, in which the plurality of guide vanes extend substantially radially from the housing.

3. A ventilation arrangement according to claim 1, in which the plurality of guide vanes comprise elongate members running substantially vertically.

4. A ventilation arrangement according to claim 3, in which the elongate members are in the form of strips of material.

5. A ventilation arrangement according to claim 1, in which the plurality of guide vanes are made of a flexible material.

6. A ventilation arrangement according to claim 5, in which the plurality of guide vanes are made of rubber or a plastics material.

7. A ventilation arrangement according to claim 1, in which each of the plurality of guide vanes is mounted to the first inner part of the housing.

8. A ventilation arrangement according to claim 1, in which the arrangement is configured such that in high wind conditions a respective guide vane can be moved by the wind to open the elongate gap.

9. A ventilation arrangement according to claim 1, in which the housing is substantially square in plan view, and a guide vane of the plurality of guide vanes is provided at each corner of the housing.

10. A ventilation arrangement according to claim 9, in which the plurality of guide vanes extend at a horizontal inclination of substantially 135° to sides of the housing.

* * * * *